US006521820B1

(12) United States Patent
Patel

(10) Patent No.: US 6,521,820 B1
(45) Date of Patent: Feb. 18, 2003

(54) TONAL ADJUSTING DEVICE

(76) Inventor: Samir K. Patel, 4922 Santa Cruz #2, San Diego, CA (US) 92107

( * ) Notice: Subject to any disclaimer, the term of this patent is extended or adjusted under 35 U.S.C. 154(b) by 22 days.

(21) Appl. No.: 09/871,850

(22) Filed: Jun. 1, 2001

(51) Int. Cl.[7] ..... G10D 3/00
(52) U.S. Cl. ..... 84/318
(58) Field of Search ..... 84/318, 319, 312 R, 84/315, 316, 317

(56) References Cited

U.S. PATENT DOCUMENTS 3,680,427 A 8/1972 Valentino
4,104,947 A * 8/1978 Oster ..... 84/318
4,143,576 A * 3/1979 Nichols et al. ..... 84/318
4,183,279 A 1/1980 Shabram
4,250,790 A * 2/1981 Shubb et al. ..... 84/318
4,324,165 A * 4/1982 Wilkerson ..... 84/318
4,334,457 A 6/1982 Spoonts
4,926,732 A 5/1990 Collins et al.
5,287,788 A 2/1994 Hill
D365,118 S 12/1995 Kyser
5,623,110 A * 4/1997 Hoglund et al. ..... 84/318

* cited by examiner

*Primary Examiner*—Kim Lockett

(57) ABSTRACT

A tonal adjusting device for selectively changing the pitch of one or more strings of a guitar. The tonal adjusting device includes a lever assembly with upper and lower arms that are designed for being positioned around the neck of a stringed instrument. The upper arm has dampening members for selectively engaging the strings when the upper arm engages the face of the neck of the instrument.

20 Claims, 4 Drawing Sheets

TONAL ADJUSTING DEVICE

BACKGROUND OF THE INVENTION

1. Field of the Invention

The present invention relates to musical capos and more particularly pertains to a new tonal adjusting device for selectively changing the pitch of one or more strings of a guitar.

2. Description of the Prior Art

The use of musical capos is known in the prior art. More specifically, musical capos heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,334,457; 4,926,732; 3,680,427; 4,183,279; 5,287,788; and U.S. Patent No. Des 365,118.

While these devices fulfill their respective, particular objectives and requirements, the aforementioned patents do not disclose a new tonal adjusting device. The inventive device includes a lever assembly with upper and lower arms that are designed for being positioned around the neck of a stringed instrument. The upper arm has dampening members for selectively engaging the strings when the upper arm engages the face of the neck of the instrument.

In these respects, the tonal adjusting device according to the present invention substantially departs from the conventional concepts and designs of the prior art, and in so doing provides an apparatus primarily developed for the purpose of selectively changing the pitch of one or more strings of a guitar.

SUMMARY OF THE INVENTION

In view of the foregoing disadvantages inherent in the known types of musical capos now present in the prior art, the present invention provides a new tonal adjusting device construction wherein the same can be utilized for selectively changing the pitch of one or more strings of a guitar.

The general purpose of the present invention, which will be described subsequently in greater detail, is to provide a new tonal adjusting device apparatus and method which has many of the advantages of the musical capos mentioned heretofore and many novel features that result in a new tonal adjusting device which is not anticipated, rendered obvious, suggested, or even implied by any of the prior art musical capos, either alone or in any combination thereof.

To attain this, the present invention generally comprises a lever assembly with upper and lower arms that are designed for being positioned around the neck of a stringed instrument. The upper arm has dampening members for selectively engaging the strings when the upper arm engages the face of the neck of the instrument.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tonal adjusting device apparatus and method which has many of the advantages of the musical capos mentioned heretofore and many novel features that result in a new tonal adjusting device which is not anticipated, rendered obvious, suggested, or even implied by any of the prior art musical capos, either alone or in any combination thereof.

It is another object of the present invention to provide a new tonal adjusting device which may be easily and efficiently manufactured and marketed.

It is a further object of the present invention to provide a new tonal adjusting device which is of a durable and reliable construction.

An even further object of the present invention is to provide a new tonal adjusting device which is susceptible of a low cost of manufacture with regard to both materials and labor, and which accordingly is then susceptible of low prices of sale to the consuming public, thereby making such tonal adjusting device economically available to the buying public.

Still yet another object of the present invention is to provide a new tonal adjusting device which provides in the apparatuses and methods of the prior art some of the advantages thereof, while simultaneously overcoming some of the disadvantages normally associated therewith.

Still another object of the present invention is to provide a new tonal adjusting device for selectively changing the pitch of one or more strings of a guitar.

Yet another object of the present invention is to provide a new tonal adjusting device which includes a lever assembly with upper and lower arms that are designed for being positioned around the neck of a stringed instrument. The upper arm has dampening members for selectively engaging the strings when the upper arm engages the face of the neck of the instrument.

Still yet another object of the present invention is to provide a new tonal adjusting device that would give the user the option of leaving any desired string or strings open, or unfretted.

Even still another object of the present invention is to provide a new tonal adjusting device that because of its unique design, would lend itself to be used with ease and versatility.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
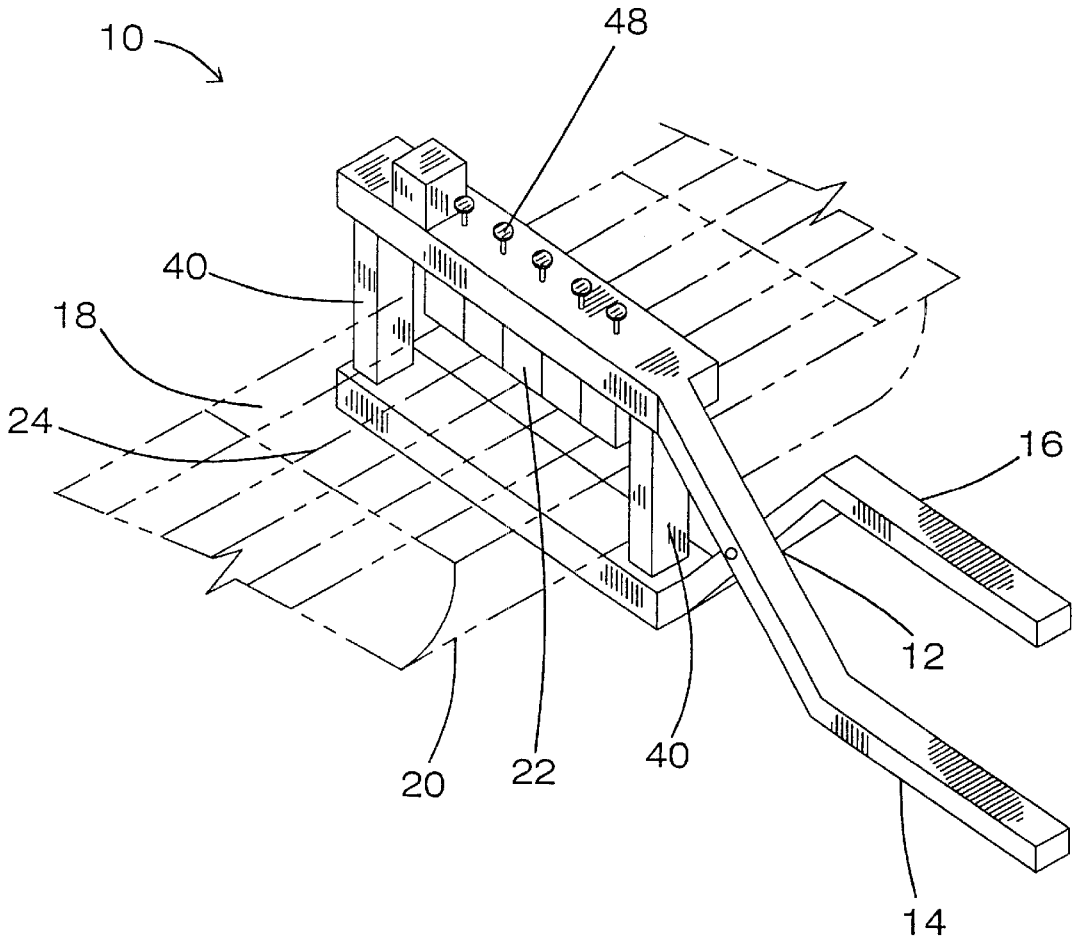
FIG. 1 is a schematic perspective view of a new tonal adjusting device according to the present invention.
Figure 2:
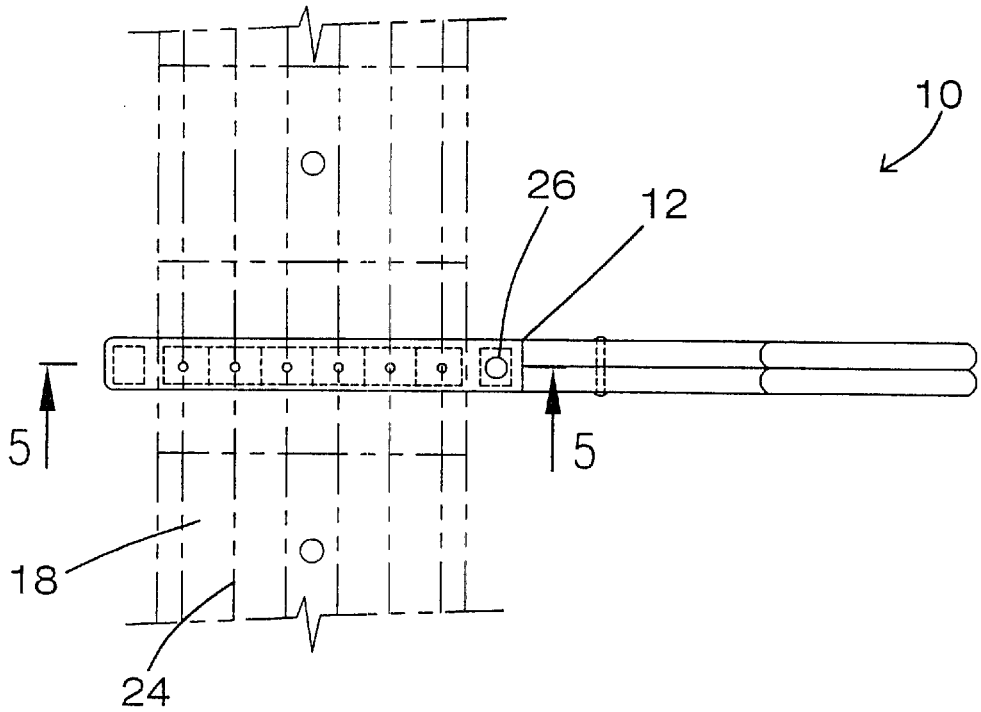
FIG. 2 is a schematic top view of the present invention.
Figure 3:
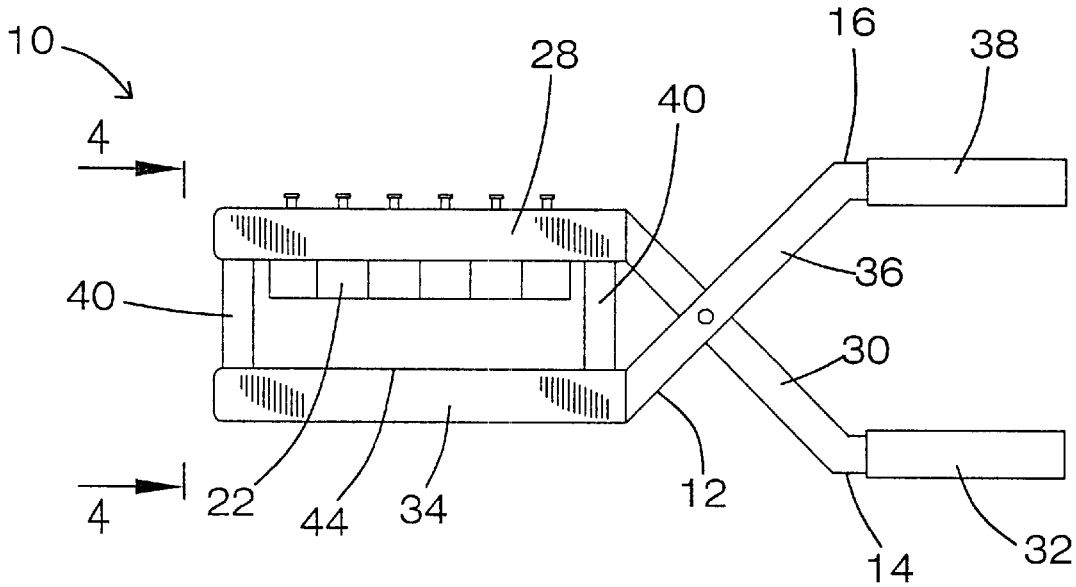
FIG. 3 is a schematic side view of the present invention.
Figure 4:
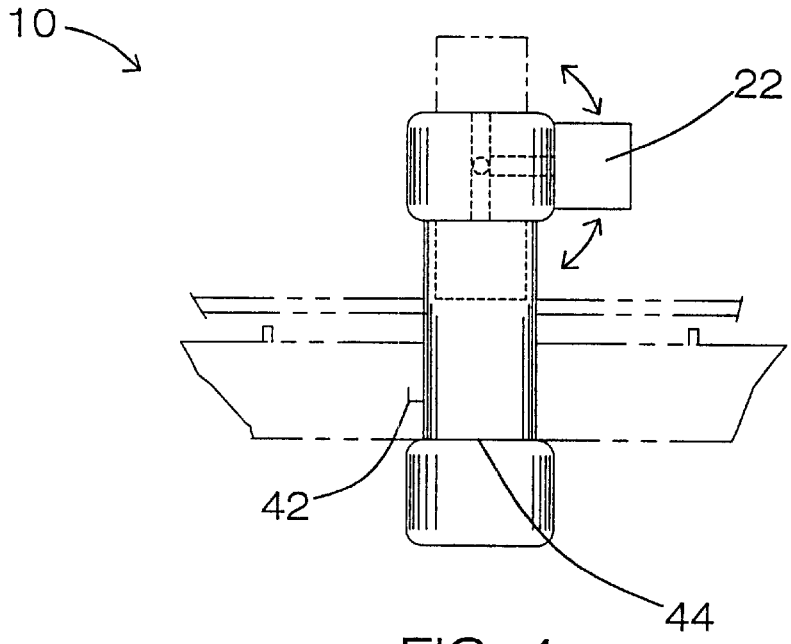
FIG. 4 is a schematic end view of the present invention.
Figure 5:
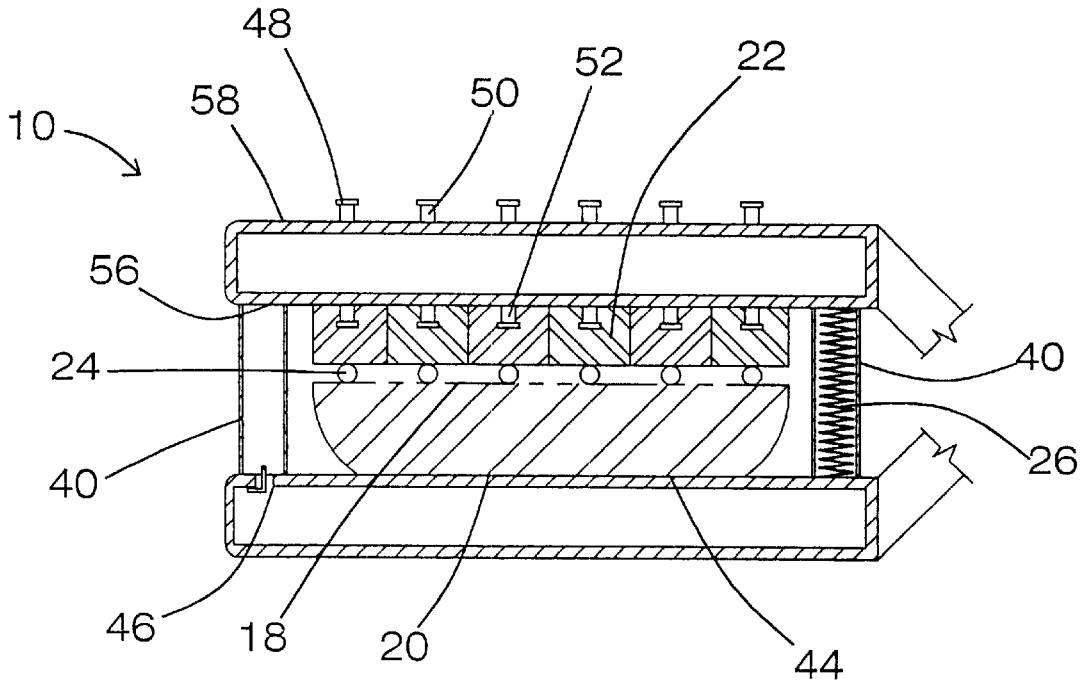
FIG. 5 is a schematic cross-sectional side view of the present invention.
Figure 6:
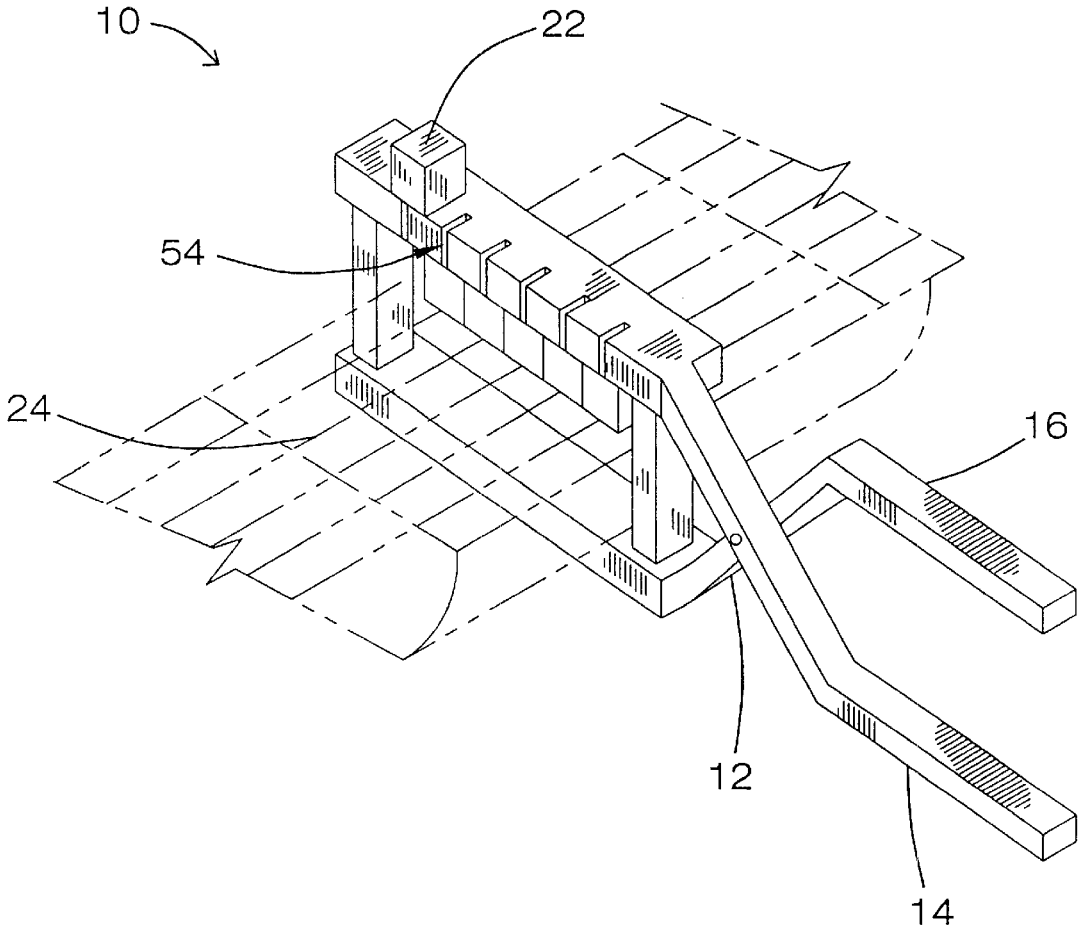
FIG. 6 is a schematic perspective view of the present invention in the alternate embodiment.

With reference now to the drawings, and in particular to FIGS. 1 through 6 thereof, a new tonal adjusting device embodying the principles and concepts of the present invention and generally designated by the reference numeral 10 will be described.

As best illustrated in FIGS. 1 through 6, the tonal adjusting device 10 generally comprises a lever assembly 12 includes an upper arm member 14 and a lower arm member 16.

The upper arm member 14 is pivotally coupled to the lower arm member 16 and is designed for selectively engaging an upper face 18 of a neck of a stringed instrument.

The lower arm member 16 is designed for selectively engaging a lower face 20 of the neck of the stringed instrument.

A plurality of engagement members 22 each is coupled to the upper arm member 14 of the lever assembly 12. Each of the engagement members 22 is designed for compressing an associated one of a plurality of strings 24 of the stringed instrument against the upper face 18 of the neck of the stringed instrument when the upper arm member 14 engages the upper face 18 of the neck of the stringed instrument. Each of the engagement members 22 is designed for dampening vibration of an associated string against the upper face 18 of the neck of the stringed instrument when the upper arm member 14 engages the upper face 18 of the neck of the instrument.

The lever assembly 12 includes a biasing member 26 that is positioned between the upper and lower arm members 14,16. The biasing member 26 is for biasing the upper arm member 14 away from the lower arm member 16 when the lever assembly 12 is released by a user such that each of the engagement members 22 are disengaged from the associated string of the stringed instrument.

The upper arm member 14 includes a bar portion 28, a medial portion 30 and a hand portion 32. The medial portion 30 is positioned between the bar portion 28 and the hand portion 32.

The lower arm member 16 includes a base portion 34, a central portion 36 and an end portion 38. The central portion. 36 is positioned between the base portion 34 and the end portion 38.

The medial portion 30 of the upper arm member 14 is pivotally coupled to the central portion 36 of the lower arm member 16 such that a distance between the bar portion 28 of the upper arm member 14 and the base portion 34 of the lower arm member 16 is decreased when a distance between the end portion 38 of the lower arm member 16 and the hand portion 32 of the upper arm member 14 is decreased.

The lever assembly 12 includes a plurality of alignment stanchions 40 coupled to the bar portion 28 of the upper arm member 14. The alignment stanchions 40 is positioned between the base portion 34 of the lower arm member 16 and the bar portion 28 of the upper bar member. Each of the alignment stanchions 40 is for maintaining alignment of the bar portion 28 of the upper arm member 14 and the base portion 34 of the lower arm member 16 when the distance between the bar portion 28 of the upper arm member 14 and the base portion 34 of the lower arm member 16 is decreased.

A locking lever 42 is pivotally coupled to one of the alignment stanchions 40. The locking lever 42 is positioned opposite the bar portion 28 of the upper arm member 14. The locking lever 42 is for selectively engaging an upper wall 44 of the base portion 34 of the lower arm member 16 through an aperture 46 in the upper wall 44. Thus the locking lever 42 is designed for securing the upper arm assembly and the lower arm assembly around the neck of the stringed instrument.

The upper arm member 14 includes a plurality of posts 48. Each engagement member 22 is for selectively mounting on one of the posts 48. The engagement members 22 are designed for dampening the vibrations of the associated string of the stringed instrument when the engagement members 22 are coupled to the posts 48 and the upper arm member 14 is engaging the top face 58 of the neck of the stringed instrument.

The plurality of posts 48 comprises an upper set of posts 50 and a lower set of posts 52. The lower set of posts 52 are aligned with the strings 24 of the stringed instrument such that each of the engagement members 22 are designed for aligning with the associated string of the stringed instrument when the engagement members 22 are mounted on the posts 48 of the lower set of posts 52. The upper set of posts 50 is positioned opposite the posts 48 of the lower set of posts 52. The upper set of posts 50 is for storing the engagement members 22 when the engagement members 22 are not coupled to the posts 48 of the lower set of posts 52.

Each of the engagement members 22 comprising a flexible material. The flexible material is designed for dampening vibrations of the strings 24 when strummed by a user. The flexible material is designed for preventing damage to the strings 24 of the stringed instrument when the engagement members 22 are dampening the strings 24.

As an alternate embodiment of the present invention, the upper arm member 14 of the lever assembly 12 includes a plurality of slots 54. Each of the slots 54 is aligned with an associated one of the engagement members 22. This permits an associated engagement member to be rotated between a bottom face 56 of the upper arm member 14 and a top face 58 of the upper arm member 14. Thereby the engagement members 22 are designed for being positioned for selectively engaging any number of the strings 24 on the stringed instrument when the upper arm member 14 engages the upper face 18 of the neck of stringed instrument.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tonal adjusting device for changing the tones of a stringed instrument, the tonal adjusting device comprising:

a lever assembly having an upper arm member and a lower arm member, said upper arm member being pivotally coupled to said lower arm member, said upper arm member being adapted for selectively engaging an upper face of a neck of the stringed instrument, said lower arm member being adapted for selectively engaging a lower face of the neck of the stringed instrument such that said lever assembly is adapted for positioning around the neck of the stringed instrument;

a plurality of engagement members each being coupled to said upper arm member of said lever assembly, each of said engagement members being adapted for compressing an associated one of a plurality of strings of the stringed instrument against the upper face of the neck of the stringed instrument when said upper arm member engages the upper face of the neck of the stringed instrument, each of said engagement members being adapted for damping vibration of an associated string against the upper face of the neck of the stringed instrument when the upper arm member engages the upper face of the neck of the instrument;

said upper arm member having a plurality of posts, each said engagement members being selectively mountable on one of said posts; and wherein each of said engagement members dampens the vibrations of an associated string of the stringed instrument when said engagement members are coupled to said posts and said upper arm member is biased towards the top face of the neck of the stringed instrument such that said engagement members are depressed onto the strings.

2. The tonal adjusting device as set forth in claim 1, further comprising:

said upper arm member having a bar portion, a medial portion and a hand portion, said medial portion being positioned between said bar portion and said hand portion, said lower arm member having a base portion, a central portion and an end portion, said central portion being positioned between said base portion and said end portion, said medial portion of said upper arm member being pivotally coupled to said central portion of said lower arm member such that a distance between said bar portion of said upper arm member and said base portion of said lower arm member is decreased when a distance between said end portion of said lower arm member and said hand portion of said upper arm member is decreased.

3. The tonal adjusting device as set forth in claim further comprising:

said lever assembly having a plurality of alignment stanchions being coupled to said bar portion of said upper arm member, said alignment stanchions being positioned between said base portion of said lower arm member and said bar portion of said upper bar member, each of said alignment stanchions being for maintaining alignment of said bar portion of said upper arm member and said base portion of said lower arm member when said distance between said bar portion of said upper arm member and said base portion of said lower arm member is decreased.

4. The tonal adjusting device as set forth in claim 3, further comprising:

a locking lever being pivotally coupled to one of said alignment stanchions, said locking lever being positioned opposite said bar portion of said upper arm member, said locking lever being for selectively engaging an upper wall of said base portion of said lower arm member through an aperture in said upper wall such that said locking lever is adapted for securing said upper arm assembly and said lower arm assembly around the neck of the stringed instrument.

5. The tonal adjusting device as set forth in claim 1, further comprising:

said upper arm member of said lever assembly having a plurality of slots, each of said slots being aligned with an associated one of said engagement members, each of said slots being for permitting an associated engagement member to be rotated between a bottom face of said upper arm member and a top face of said upper arm member such that said engagement members are adapted for being positioned for selectively engaging any number of the strings on the stringed instrument when said upper arm member engages the top face of the neck of stringed instrument.

6. The tonal adjusting device as set forth in claim 1, further comprising:

said plurality of posts comprising an upper set of posts and a lower set of posts, said lower set of posts being aligned with the strings of the stringed instrument such that each of said engagement members are adapted for aligning with the associated string of the stringed instrument when said engagement members are mounted on said posts of said lower set of posts, said upper set of posts being positioned opposite said posts of said lower set of posts, said upper set of posts being for storing said engagement members when said engagement members are not coupled to said posts of said lower set of posts.

7. The tonal adjusting device as set forth in claim 1, further comprising:

each of said engagement members comprising a flexible material, said flexible material being adapted for dampening vibrations of the strings when strummed by a user, said flexible material being adapted for preventing damage to the strings of the stringed instrument when said each of said engagement members is dampening one of the strings.

8. A tonal adjusting device for changing the tones of a stringed instrument, the tonal adjusting device comprising:

a lever assembly having an upper arm member and a lower arm member, said upper arm member being pivotally coupled to said lower arm member, said upper arm member being adapted for selectively engaging an upper face of a neck of the stringed instrument, said lower arm member being adapted for selectively engaging a lower face of the neck of the stringed instrument such that said lever assembly is adapted for positioning around the neck of the stringed instrument;

a plurality of engagement members each being coupled to said upper arm member of said lever assembly, each of said engagement members being adapted for compressing an associated one of a plurality of strings of the stringed instrument against the upper face of the neck of the stringed instrument when said upper arm member engages the upper face of the neck of the stringed instrument, each of said engagement members being adapted for damping vibration of an associated string against the upper face of the neck of the stringed instrument when the upper arm member engages the upper face of the neck of the instrument; and said upper arm member of said lever assembly having a plurality of slots, each of said slots being aligned with an associated one of said engagement members, each of said slots being for permitting an associated engagement member to be rotated between a bottom face of said upper arm member and a top face of said upper arm member such that said engagement members are adapted for being positioned for selectively engaging any number of the strings on the stringed instrument when said upper arm member engages the top face of the neck of stringed instrument.

9. The tonal adjusting device as set forth in claim 8, further comprising:

said upper arm member having a bar portion, a medial portion and a hand portion, said medial portion being positioned between said bar portion and said hand portion, said lower arm member having a base portion, a central portion and an end portion, said central portion being positioned between said base portion and said end portion, said medial portion of said upper arm member being pivotally coupled to said central portion of said lower arm member such that a distance between said bar portion of said upper arm member and said base portion of said lower arm member is decreased when a distance between said end portion of said lower arm member and said hand portion of said upper arm member is decreased.

10. The tonal adjusting device as set forth in claim 9, further comprising:

said lever assembly having a plurality of alignment stanchions being coupled to said bar portion of said upper arm member, said alignment stanchions being positioned between said base portion of said lower arm member and said bar portion of said upper bar member, each of said alignment stanchions being for maintaining alignment of said bar portion of said upper arm member and said base portion of said lower arm member when said distance between said bar portion of said upper arm member and said base portion of said lower arm member is decreased.

11. The tonal adjusting device as set forth in claim 10, further comprising:

a locking lever being pivotally coupled to one of said alignment stanchions, said locking lever being positioned opposite said bar portion of said upper arm member, said locking lever being for selectively engaging an upper wall of said base portion of said lower arm member through an aperture in said upper wall such that said locking lever is adapted for securing said upper arm assembly and said lower arm assembly around the neck of the stringed instrument.

12. The tonal adjusting device as set forth in claim 8, further comprising:

said upper arm member having a plurality of posts, each said engagement members being selectively mountable on one of said posts; and wherein each of said engagement members dampens the vibrations of an associated string of the stringed instrument when said engagement members are coupled to said posts and said upper arm member is biased towards the top face of the neck of the stringed instrument such that said engagement members are depressed onto the strings.

13. The tonal adjusting device a s set forth in claim 12, further comprising:

said plurality of posts comprising an upper set of posts and a lower set of posts, said lower set of posts being aligned with the strings of the stringed instrument such that each of said engagement members are adapted for aligning with the associated string of the stringed instrument when said engagement members are mounted on said posts of said lower set of posts, said upper set of posts being positioned opposite said posts of said lower set of posts, said upper set of posts being for storing said engagement members when said engagement members are not coupled to said posts of said lower set of posts.

14. The tonal adjusting device as set forth in claim 8, further comprising:

each of said engagement members comprising a flexible material, said flexible material being adapted for dampening vibrations of the strings when strummed by a user, said flexible material being adapted for preventing damage to the strings of the stringed instrument when said each of said engagement members is dampening one of the strings.

15. A tonal adjusting device for changing the tones of a stringed instrument, the tonal adjusting device comprising:

a lever assembly having an upper arm member and a lower arm member, said upper arm member being pivotally coupled to said lower arm member, said upper arm member being adapted for selectively engaging an upper face of a neck of the stringed instrument, said lower arm member being adapted for selectively engaging a lower face of the neck of the stringed instrument such that said lever assembly is adapted for positioning around the neck of the stringed instrument;

a plurality of engagement members each being coupled to said upper arm member of said lever assembly, each of said engagement members being adapted for compressing an associated one of a plurality of strings of the stringed instrument against the upper face of the neck of the stringed instrument when said upper arm member engages the upper face of the neck of the stringed instrument, each of said engagement members being adapted for damping vibration of an associated string against the upper face of the neck of the stringed instrument when the upper arm member engages the upper face of the neck of the instrument; and each of said engagement members comprising a flexible material, said flexible material being adapted for dampening vibrations of the strings when strummed by a user, said flexible material being adapted for preventing damage to the strings of the stringed instrument when said each of said engagement members is dampening one of the strings.

16. The tonal adjusting device as set forth in claim 15, further comprising:

said upper arm member having a bar portion, a medial portion and a hand portion, said medial portion being positioned between said bar portion and said hand portion, said lower arm member having a base portion, a central portion and an end portion, said central portion being positioned between said base portion and said end portion, said medial portion of said upper arm member being pivotally coupled to said central portion of said lower arm member such that a distance between said bar portion of said upper arm member and said base portion of said lower arm member is decreased when a distance between said end portion of said lower arm member and said hand portion of said upper arm member is decreased.

17. The tonal adjusting device as set forth in claim 16, further comprising:

said lever assembly having a plurality of alignment stanchions being coupled to said bar portion of said upper arm member, said alignment stanchions being positioned between said base portion of said lower arm member and said bar portion of said upper bar member, each of said alignment stanchions being for maintaining alignment of said bar portion of said upper arm member and said base portion of said lower arm member when said distance between said bar portion of said upper arm member and said base portion of said lower arm member is decreased.

18. The tonal adjusting device as set forth in claim 15, further comprising:

said upper arm member of said lever assembly having a plurality of slots, each of said slots being aligned with an associated one of said engagement members, each of said slots being for permitting an associated engagement member to be rotated between a bottom face of said upper arm member and a top face of said upper arm member such that said engagement members are adapted for being positioned for selectively engaging any number of the strings on the stringed instrument when said upper arm member engages the top face of the neck of stringed instrument.

19. The tonal adjusting device as set forth in claim 15, further comprising:

said upper arm member having a plurality of posts, each said engagement members being selectively mountable on one of said posts; and wherein each of said engagement members dampens the vibrations of an associated string of the stringed instrument when said engagement members are coupled to said posts and said upper arm member is biased towards the top face of the neck of the stringed instrument such that said engagement members are depressed onto the strings.

20. The tonal adjusting device as set forth in claim 19, further comprising:

said plurality of posts comprising an upper set of posts and a lower set of posts, said lower set of posts being aligned with the strings of the stringed instrument such that each of said engagement members are adapted for aligning with the associated string of the stringed instrument when said engagement members are mounted on said posts of said lower set of posts, said upper set of posts being positioned opposite said posts of said lower set of posts, said upper set of posts being for storing said engagement members when said engagement members are not coupled to said posts of said lower set of posts.

* * * * *